United States Patent [19]

Yoshida et al.

[11] Patent Number: 4,548,116

[45] Date of Patent: Oct. 22, 1985

[54] APPARATUS FOR PRODUCING HOOKS ON LOOP-AND-HOOK FASTENERS

[75] Inventors: Hiroshi Yoshida, Kurobe; Ryuichi Murasaki, Tateyama, both of Japan

[73] Assignee: Yoshida Kogyo K. K., Tokyo, Japan

[21] Appl. No.: 513,014

[22] Filed: Jul. 12, 1983

[30] Foreign Application Priority Data

Jul. 13, 1982 [JP] Japan ..... 57-121433

[51] Int. Cl.[4] ..... D06C 13/08

[52] U.S. Cl. ..... 83/444; 83/438; 83/701; 26/9

[58] Field of Search ..... 83/13, 701, 433, 425.3, 83/171, 444, 437, 438; 26/9; 28/161

[56] References Cited

U.S. PATENT DOCUMENTS 3,468,203 9/1969 Armelin ..... 83/433
3,727,433 4/1973 Hamano ..... 26/9 X
3,765,193 10/1973 Conroux ..... 26/9 X
4,429,441 2/1984 Nishiyama ..... 26/9

FOREIGN PATENT DOCUMENTS 223348 1/1958 Australia ..... 26/9
57-12603 3/1982 Japan .

*Primary Examiner*—E. R. Kazenske
*Assistant Examiner*—John L. Knoble
*Attorney, Agent, or Firm*—Hill, Van Santen, Steadman & Simpson

[57] ABSTRACT

A loop guide has a plurality of transversely spaced loop guide comb teeth for guiding loops of thermoplastic resin therealong into contact with cutter blades of an ultrasonically vibratable cutter to cut off only one of two legs of each loop. The other legs that remain unsevered serve as hooks on a hook-and-loop fastener.

4 Claims, 8 Drawing Figures

APPARATUS FOR PRODUCING HOOKS ON LOOP-AND-HOOK FASTENERS

BACKGROUND OF THE INVENTION

1. Field of the Invention: The present invention relates to an apparatus for producing hooks on loop-and-hook fasteners with an ultrasonically vibratable cutter.

2. Description of the Prior Art:

Known apparatus for producing hooks on loop-and-hook fasteners include a cutter vibratable under ultrasonic energy and a fixed cutter for jointly guiding loops to be cut off from a loop tape. The known apparatus is disadvantageous in that the ultrasonically vibratable cutter tends to contact portions of loops which should not be cut off, thus severing or otherwise damaging such loop portions. When the ultrasonically vibratable cutter happens to engage both legs of a loop, the legs are completely cut off from the loop tape. To prevent such undesirable cutting of loops, the ultrasonically vibratable cutter should be kept out of contact with the loops, which then could not be raised and guided properly and hence would be cut off at different heights. Another problem with the prior apparatus is that loop tapes or sheets with loops interknitted or interwoven therein should be fabricated with great care for dimensional accuracy and the apparatus should be operated under strict control to protect loop legs from unwanted severance.

SUMMARY OF THE INVENTION

It is an object of the present invention to provide an apparatus for producing hooks on loop-and-hook fasteners by guiding hook-forming loops to proper cutting positions and by cutting off such hook-forming loops at a constant height without causing undesirable damage or severance of the loops.

According to the present invention, an apparatus for producing hooks on hook-and-loop fasteners includes a loop guide having a plurality of loop guide comb teeth having tapered distal ends for guiding and raising hook-forming loops of a loop sheet as it is fed along on a sheet guide. The apparatus also has a cutter connected to an ultrasonic horn and including a plurality of cutter blades having cutting edges extending transversely across alternating spaces between the loop guide comb teeth or side edges of the loop guide comb teeth. When the loop sheet moves forward on the sheet guide, one of the legs of each loop is ultrasonically cut off by a corresponding one of the cutting edges upon contact therewith while the other leg remains unsevered and will serve as a hook on the loop sheet.

Many other advantages and features of the present invention will become manifest to those versed in the art upon making reference to the detailed description and the accompanying sheets of drawings in which preferred embodiments are shown by way of illustrative example.

DETAILED DESCRIPTION

Figure 1:
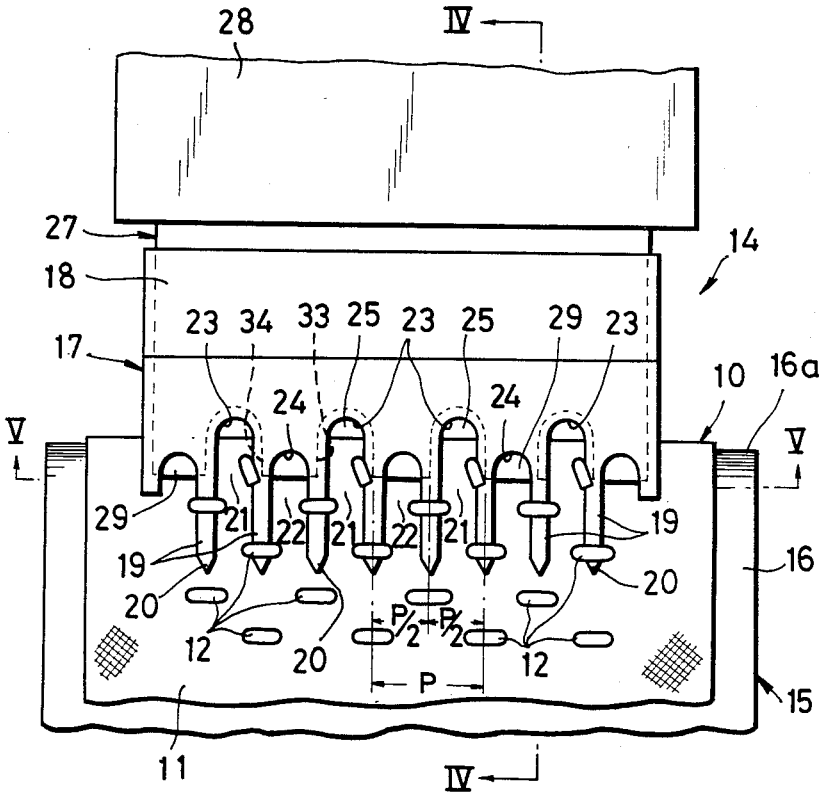
FIG. 1 is a fragmentary plan view of an apparatus for producing hooks on hook-and-loop fasteners according to the present invention.
Figure 4:
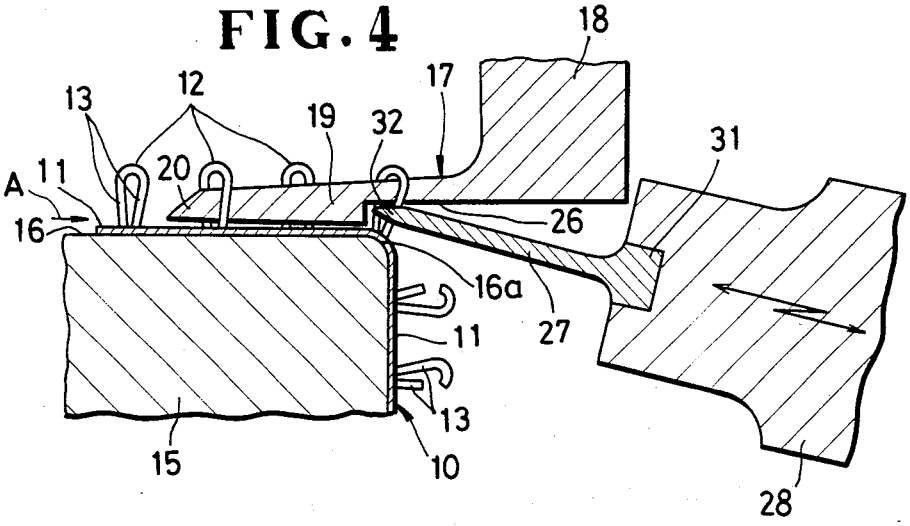
FIG. 4 is a cross-sectional view taken along line IV—IV of FIG. 1.
Figure 5:
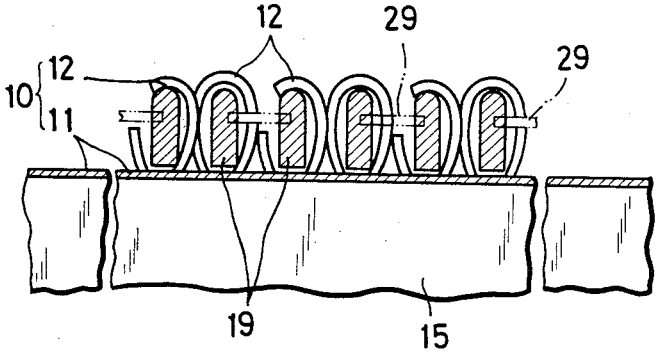
FIG. 5 is a cross-sectional view taken along line V—V of FIG. 1.

As shown in FIGS. 1, 4 and 5, a loop sheet or tape 10 is composed of a foundation fabric 11 and a multiplicity of projecting loops 12 in the form of monofilaments of thermoplastic synthetic resin interknitted or interwoven in the foundation fabric 11 and arranged in rows and tiers at predetermined intervals or pitches. Each loop 12 has a pair of interconnected legs 13, 13 (FIG. 4) spaced from each other transversely of the foundation fabric 11. As illustrated in FIG. 1, the loops 12 in each transverse row are spaced at intervals or pitches P, and the loops 12 in alternating transverse rows are transversely staggered by pitches P/2. The staggered loops 12 in alternating transverse rows are longitudinally aligned in tiers.

An apparatus 14 for forming hooks according to the present invention comprises a sheet or tape guide 15 for slidably supporting the loop sheet 10 which is continuously fed along horizontally (as shown in FIG. 1) by a sheet feed mechanism (not shown). The loop sheet 10 as it is fed on and along an upper surface 16 of the sheet guide 15 turns around a curved or rounded corner 16*a* and moves in a downward direction (as shown in FIG. 4).

Figure 2:
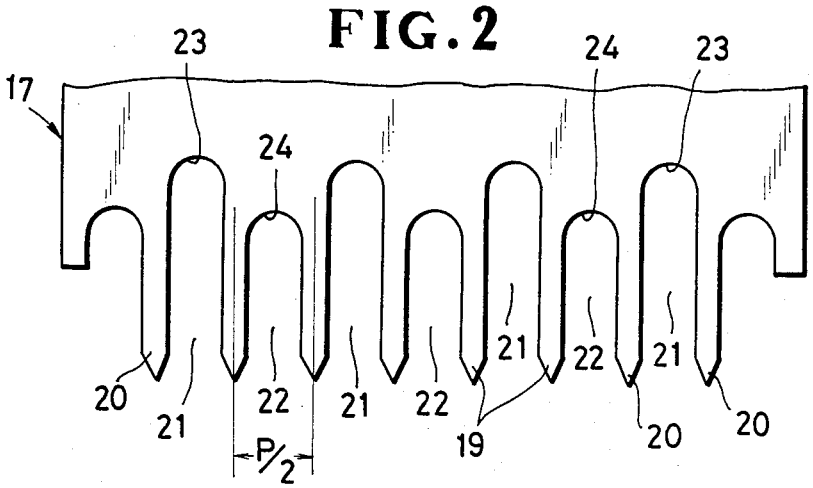
FIG. 2 is a fragmentary plan view of a loop guide of the apparatus shown in FIG. 1.

The apparatus also has a fixed loop guide 17 including a guide body 18 and a plurality of equally spaced, parallel guide comb teeth 19 extending from the guide body 18 in overhanging relation to the sheet guide surface 16 (FIG. 4). Each of the guide comb teeth 19 has a tapered distal end 20 defined by slanted upper and side surfaces and an intermediate upper surface extending obliquely between the tapered distal end 20 and the guide body 18. The guide comb teeth 19 have longitudinal axes transversely spaced by the distance equal to half of the pitch P, as shown in FIGS. 1 and 2. Between the guide comb teeth 19, there are defined alternating longer and shorter spaces 21, 22 extending toward the guide body 18 and having semicircular edges 23, 24, respectively, remote from the tapered distal ends 20 of the guide comb teeth 19. The guide body 18 is positioned forward of the sheet guide 15 with the guide comb teeth 19 extending in longitudinal alignment with the tiers of loops 12 on the foundation fabric 11 out of contact with the latter, as best shown in FIG. 4. As illustrated in FIG. 1, the semicircular edges 23 of the longer spaces 21 and a front edge of the sheet guide 15 jointly define a plurality of semicircular windows 25. The loop guide 17 has a lower recess 26 (FIG. 4) opening downwardly and extending from the guide body 18 to a position adjacent to the round corner 16*a* of the sheet guide 15.

Figure 3:
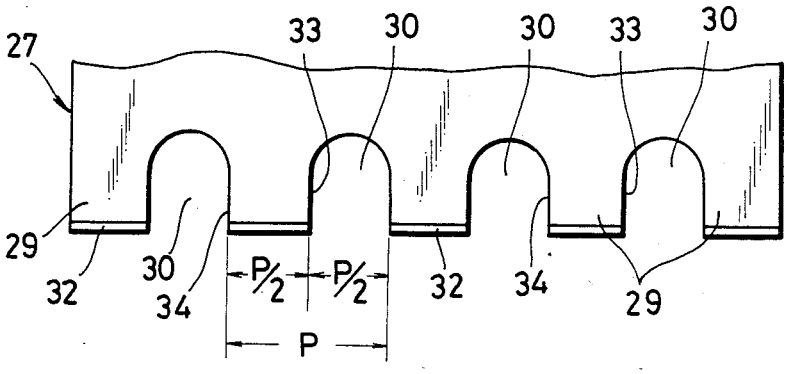
FIG. 3 is a fragmentary plan view of a loop cutter of the apparatus of FIG. 1.

A cutter 27 is disposed below the loop guide 17 and has a base portion 31 fixedly attached to a horn 28 (FIGS. 1 and 4) of an ulstrasonic generator (not shown). The cutter 27 has a plurality of cutter blades 29 laterally equally spaced with spaces 30 defined therebetween. Each of the cutter blades 29 includes a tapered cutting edge 32. The cutter blades 29 are transversely spaced at intervals each equal to the pitch P, with each cutter blade 29 having a width P/2. Therefore, each of the spaces 30 has a width P/2. As shown in FIG. 4, the cutter 27 extends obliquely and has its distal end portion with the cutter blades 29 located in the recess 26. The cutter blades 29 are located in longitudinal alignment with the shorter spaces 22 (FIG. 1) with the cutting edges 32 extending laterally across the spaces 22 beyond the semicircular edges 24 and placed over the round corner 16*a* of the sheet guide 15. Each of the cutter blades 29 has a pair of side edges 33, 34 (FIG. 3) aligned with the central axes of adjacent guide comb teeth 19 disposed laterally across one of the shorter spaces 22, as shown in FIGS. 1 and 5. The spaces 30 between the cutter blades 29 are held substantially in registry with the longer spaces 21 in the transverse direction.

Operation of the apparatus of the foregoing construction is as follows: When the loop sheet 10 is fed along in the direction of the arrow A (FIG. 4), the comb teeth 19 are inserted into the loops 12 in longitudinal tiers, and the loops 12 are guided by the comb teeth 19 and raised thereby into upstanding position. When the legs 13 of the loops 12 moving into the shorter spaces 22 are brought into contact with the cutting edges 32 of the cutter blades 29, the loop legs 13 are cut off by the ultrasonically vibrating cutter blades 29. As the loop sheet 10 travels along in the direction of the arrow A, the severed legs 13 move below the cutter blades 29 while the other legs 13 move through the longer spaces 21 and then the semicircular windows 25. Thereafter, the cut-off loops 12 turn around the round corner 16*a* and slide down the sheet guide 15 as shown in FIG. 4. The legs 13 which have not been cut off by the cutter blades 29 will serve as hooks on the loop sheet 10 for engagement with piles (not shown) on the loop tape of a hook-and-loop fastener.

With the arrangement of the present invention, each cutter blade 29 serves to cut off legs of the loops 12 in adjacent longitudinal tiers. In each transverse row, the loops 12 have severed legs 13 positioned on the same side. Similarly, in each longitudinal tier, the loops 12 also have severed legs 13 on the same side. The loops 12 in transverse rows can be divided into two alternate groups; one group having their lefthand legs 13 (FIG. 1) severed, and the other group having their righthand legs 13 severed. Likewise, the loops 12 in longitudinal tiers can be divided into two alternate groups; one group having their lefthand legs 13 (FIG. 1) severed, and the other group having their righthand legs 13 severed.

The loops 12 prior to their being severed can reliably be raised by the comb teeth 19 so as to be cut off by the cutter blades 29 properly at uniform heights. Since the cutter blades 29 are located alternately at the shorter spaces 22, only one of the legs 13 of each loop 12 is cut off, while the other leg is protected against unwanted severance or damage.

Figure 6:
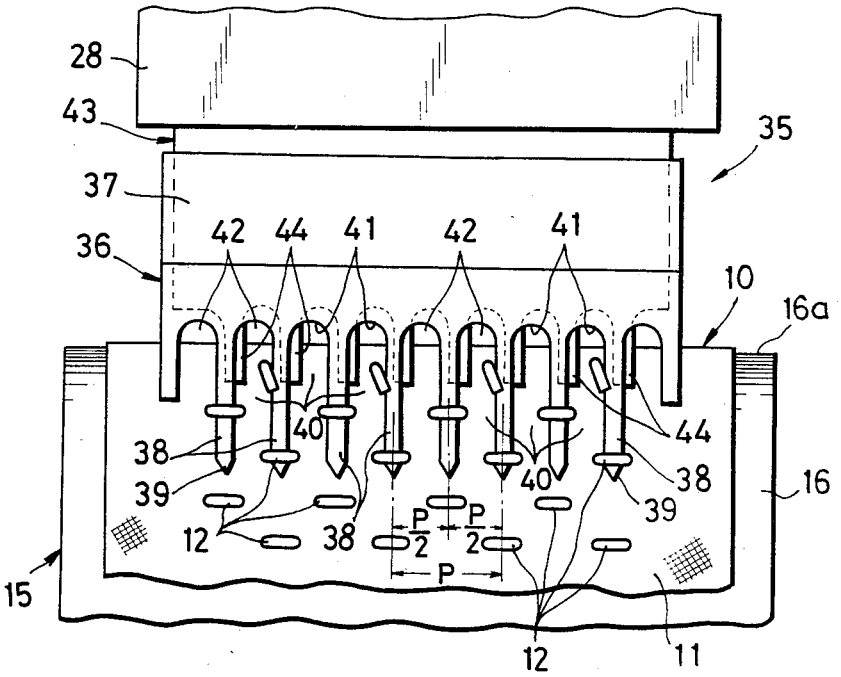
FIG. 6 is a fragmentary plan view of another embodiment of the present invention.

FIG. 6 shows an apparatus 35 according to another embodiment of the present invention. The apparatus 35 has a loop guide 36 including a guide body 37 and a plurality of loop guide comb teeth 38 positioned in overhanging relation to the upper surface 16 of the sheet guide 15 and having tapered distal ends 39. The loop guide comb teeth 38 are spaced transversely with elongate spaces 40 defined therebetween, the spaces 40 having an equal length. The spaces 40 have semicircular edges 41 which cooperate with the round corner 16*a* of the sheet guide 15 in defining a plurality of semicircular windows 42. The apparatus 35 also includes a cutter 43 secured to the ultrasonic horn 28 and having a plurality of cutter blades 44 below the guide comb teeth 38. The loop guide comb teeth 38 are held in longitudinal alignment with the tiers of loops 12 of the loop sheet 10. Therefore, the loop guide comb teeth 38 have central axes spaced by a distance equal to P/2. Each of the cutter blades 44 has a width which is substantially the same as that of one of the loop guide comb teeth 38.

Each of the cutter blades 44 is transversely displaced out of exact alignment with a corresponding one of the loop guide comb teeth 38 by a distance which is substantially equal to half of the width of the cutter blade 44. The cutter blade 44 has a lateral half portion underlying the corresponding loop guide comb tooth 38 and has the other half exposed in an adjacent one of the spaces 40. Each cutter blade 44 has a tapered cutting edge located partly in one of the spaces 40 over the round corner 16*a* of the sheet guide 15.

In operation, the loops 12 in longitudinal tiers are guided over and along the loop guide comb teeth 38 as the loop sheet 10 is fed along. The loops 12 are lifted by the loop guide comb teeth 38 and then are ultrasonically cut off at one of their legs by the cutter blades 44 upon contact therewith. The severed loops 12 are then moved through the windows 42 with the loop sheet 10.

With the apparatus shown in FIG. 6, the cutter blades 44 are laterally spaced at intervals equal to those of the lateral spacing of the loop guide comb teeth 38, the cutter blades 44 being laterally displaced out of alignment with the loop guide comb teeth 38. The cutter blades 44 can cut off legs of the loops 12 which are located on the same side (righthand side as shown in FIG. 6) in all of the longitudinal tiers.

Figure 7:
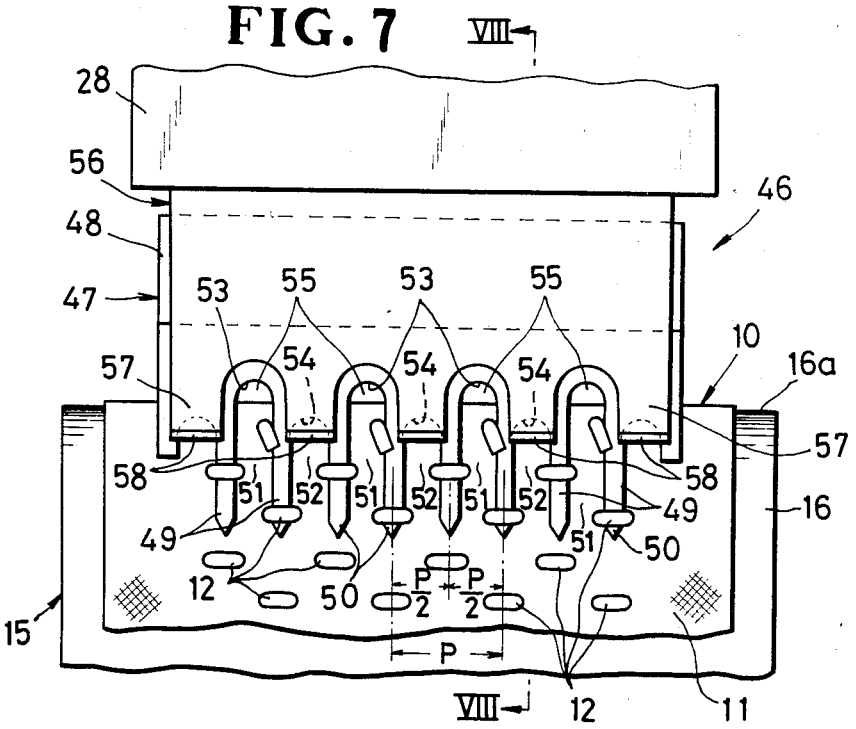
FIG. 7 is a fragmentary plan view of still another embodiment of the present invention.
Figure 8:
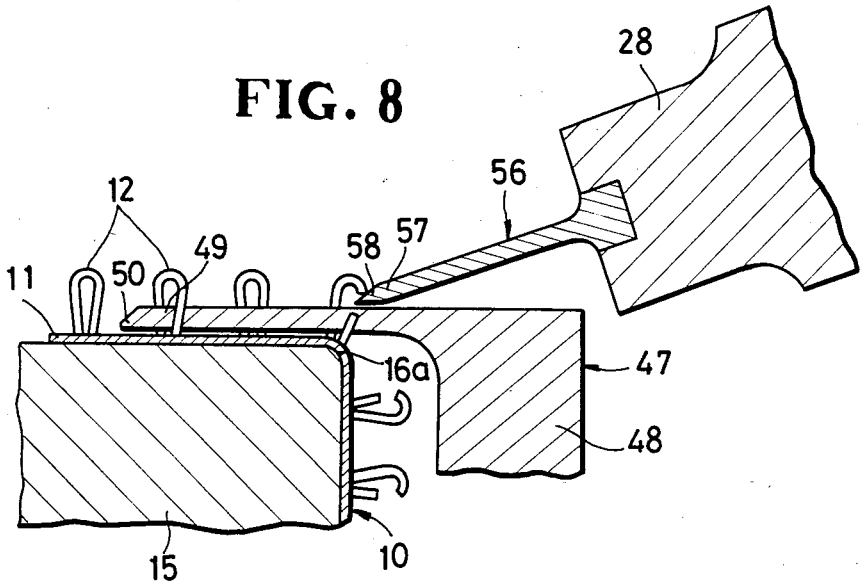
FIG. 8 is a cross-sectional view taken along line VIII—VIII of FIG. 7.

According to still another embodiment illustrated in FIGS. 7 and 8, an apparatus 46 has a loop guide 47 having a guide body 48 and a plurality of loop guide comb teeth 49 having tapered distal ends 50 and extending longitudinally over the upper surface 16 of the sheet guide 15. The loop guide comb teeth 49 are laterally spaced with longer and shorter spaces 51, 52 defined therebetween. The longer spaces 51 have semicircular edges 53 defining semicircular windows 55 with the rounded corner 16*a* of the sheet guide 15. The shorter spaces 52 have semicircular edges 54 positioned substantially above the rounded corner 16*a* of the sheet guide 15. The apparatus 46 further includes a cutter 56 mounted on the ultrasonic horn 28 and positioned upwardly of the loop guide 47. The cutter 56 has a plurality of transversely spaced, parallel cutter blades 57 each having a cutting edge 58 extending transversely across one of the shorter spaces 52 beyond the semicircular edge 54. The loop guide comb teeth 49 are longitudinally aligned with the loops 12 of the loop sheet 10. Each of the cutter blades 57 has a width slightly smaller than the distance between the central axes of adjacent loop guide comb teeth 49, the distance being equal to half of the pitch P.

The apparatus 46 operates as follows: As the loop sheet 10 travels, the loops 12 are guided and raised by the loop guide comb teeth 49, and only one of their legs is ultrasonically cut off by the cutter blades 57 upon contact therewith. The severed legs are moved under the cutting edges 58 while the other legs are moved through the windows 55 as the loop sheet 10 turns around the rounded corner 16*a*.

Although various minor modifications may be suggested by those versed in the art, it should be understood that we wish to embody within the scope of the patent warranted hereon, all such embodiments as reasonably and properly come within the scope of our contribution to the art.

What is claimed is:

1. An apparatus for producing hooks on hook-and-loop fasteners, comprising:

(a) a sheet guide having a guide surface for slidably supporting thereon a loop sheet with a plurality of loops of thermoplastic synthetic resin each having a pair of legs and arranged in transverse rows and longitudinal tiers;

(b) a loop guide having a plurality of parallel loop guide comb teeth each having parallel sides and extending in overhanging relation to said guide surface for guiding said loops in said tiers along said loop guide comb teeth;

(c) an ultrasonically vibratable cutter spaced from said loop guide and having a plurality of aligned leading cutter edges extending perpendicularly across selected side edges of said loop guide comb teeth and spaced therefrom for cutting off a selected one of the legs of each loop under ultrasonic energy when the loops are guided along said loop guide comb teeth into contact with said cutter edges; and said loop guide comb teeth being transversely spaced with spaces defined therebetween, said spaces being alternately longer and shorter in a longitudinal direction, each of said cutter edges respectively extending continually solely across only one of the shorter spaces.

2. An apparatus according to claim 1, said aligned cutter edges having spaces defined therebetween continually held in registry with said longer spaces.

3. An apparatus for producing hooks on hook-and-loop fasteners, comprising:

(a) a sheet guide having a guide surface for slidably supporting thereon a loop sheet with a plurality of loops of thermoplastic synthetic resin each having a pair of legs and arranged in transverse rows and longitudinal tiers;

(b) a loop guide having a plurality of parallel loop guide comb teeth each having parallel sides and extending in overhanging relation to said guide surface for guiding said loops in said tiers along said loop guide comb teeth;

(c) an ultrasonically vibratable cutter spaced from said loop guide and having a plurality of aligned leading cutter edges extending perpendicularly across selected side edges of said loop guide comb teeth and spaced therefrom for cutting off a selected one of the legs of each loop under ultrasonic energy when the loops are guided along said loop guide comb teeth into contact with said cutter edges; and (d) each of said cutter edges respectively extending continually perpendicularly across only one side of each of said loop guide comb teeth.

4. An apparatus for producing hooks on hook-and-loop fasteners, comprising:

(a) a sheet guide having a guide surface for slidably supporting thereon a loop sheet with a plurality of free-standing loops of thermoplastic synthetic resin each having a pair of legs and arranged in transverse rows and longitudinal tiers;

(b) a loop guide having a plurality of parallel loop guide comb teeth each having parallel sides and extending in overhanging relation to said guide surface for guiding said loops in said tiers along said loop guide comb teeth, said loop guide comb teeth having tapered distal ends extending from said parallel sides for entering the uncut loops in said longitudinal tiers as the uncut loops of the loop sheet are fed toward said tapered ends, said loop guide having a recess at the lower side of said teeth opening downwardly and communicating upwardly with the spaces between said teeth; and (c) an ultrasonically vibratable cutter spaced from said loop guide and having a plurality of aligned leading cutter edges extending perpendicularly across selected side edges of said loop guide comb teeth and spaced therefrom for cutting off a selected one of the legs of each loop under ultrasonic energy when the loops are guided along said loop guide comb teeth into contact with said cutter edges, said cutter edges being positioned in said recess, whereby the cut loops leave said teeth at the supported tooth end and pass into said recess.

* * * * *